US005139006A

United States Patent [19]

Trudeau

[11] Patent Number: 5,139,006

[45] Date of Patent: Aug. 18, 1992

[54] HYDRAULIC CONCRETE PILE CUTTER

[76] Inventor: Leon B. Trudeau, 138 Tufnell Drive, Winnipeg, Manitoba, Canada, R2N 1J8

[21] Appl. No.: 553,387

[22] Filed: Jul. 17, 1990

Related U.S. Application Data

[63] Continuation-in-part of Ser. No. 331,958, Apr. 3, 1989, abandoned.

[51] Int. Cl.[5] ..... B28D 1/32

[52] U.S. Cl. ..... 125/12; 125/16.01; 83/694

[58] Field of Search ..... 125/12, 16.01, 23.01; 83/639, 694, 821, 824, 928; 30/289, 294; 144/34 R, 34 E

[56] References Cited

U.S. PATENT DOCUMENTS

| | | | |
|---|---|---|---|
| 2,612,194 | 9/1952 | Ingraham et al. | 144/34 E |
| 2,808,822 | 10/1957 | Celapino | 125/23 |
| 2,819,710 | 1/1958 | Mangis | 125/23 C |
| 3,056,267 | 10/1962 | McRee | 125/23 X |
| 3,392,719 | 7/1968 | Clanton | 125/23 |
| 3,491,811 | 1/1970 | Larson et al. | 83/639 X |
| 3,495,489 | 2/1970 | Savory | 83/639 X |
| 3,727,600 | 4/1973 | Schlough | 125/23 |
| 4,114,270 | 9/1978 | Jansen-Herfeld et al. | 83/82 X |
| 4,124,015 | 11/1978 | Isaksson | 125/23 R |
| 4,197,828 | 4/1980 | Schellhorn | 125/23 C |
| 4,273,171 | 6/1981 | Spaulding | 83/928 X |
| 4,641,694 | 2/1987 | Rohde | 144/34 E X |
| 4,979,489 | 12/1990 | Abbasov et al. . | |

FOREIGN PATENT DOCUMENTS

| | | | |
|---|---|---|---|
| 215878 | 11/1960 | Austria | 125/23 C |
| 133016 | 3/1910 | Canada | 125/23 R |
| 167684 | 2/1916 | Canada | 125/23 R |
| 909672 | 9/1972 | Canada | 125/23 R |
| 1142417 | 3/1983 | Canada | 125/23 R |
| 1143255 | 3/1983 | Canada | 125/23 R |
| 1219789 | 3/1987 | Canada | 125/23 R |
| 0051837 | 5/1982 | European Pat. Off. . | |
| 0243981 | 11/1987 | European Pat. Off. . | |
| 0353303 | 2/1990 | European Pat. Off. . | |
| 2219134 | 4/1973 | Fed. Rep. of Germany | 125/23 |
| 2505298 | 11/1975 | Fed. Rep. of Germany | 125/23 R |
| 3122848 | 1/1983 | Fed. Rep. of Germany | 125/23 R |
| 8400404 | 9/1985 | Netherlands | 125/23 R |
| 8705064 | 8/1987 | PCT Int'l Appl. | 125/23 R |

OTHER PUBLICATIONS

Civil Engineering and Public Works Review, "Engineering Developments in the U.S.S.R.", Dec. 1964, vol. 59, No. 12, London, p. 1511.

International Construction, Sep. 1988, p. 52 advertisement by ACODEQ "Pile Breaker".

*Primary Examiner*—M. Rachuba

*Attorney, Agent, or Firm*—Murray E. Thrift; Adrian D. Battison; Stanley G. Ade

[57] ABSTRACT

A hydraulic concrete pile cutter includes a blade and a method of cutting reinforced precast concrete piles at grade level. A single blade of suitable hardness limits up to about Rockwell C 56, has a beveled cutting edge extending across most of one edge, bordered by unbeveled side portions, adapted to slide in channels. The single blade is used to shear reinforced precast concrete piles. A double blade arrangement with a fixed blade opposed to a movable blade, both blades having cutting edges formed to fit around the pile, is also taught. The double blades shear the concrete of the pile leaving the reinforcement intact. The movable blade is actuated by hydraulic cylinders, two hydraulic cylinders to provide the required power are preferred, because they have less tendency to jam the blade, during use. An anvil or stop extends across the outer ends of the channels, and is removable. Projecting attachments for concrete breaking and recessed attachments for pile guiding are also shown.

8 Claims, 10 Drawing Sheets

HYDRAULIC CONCRETE PILE CUTTER

This invention relates in one aspect to a cutting device for precast concrete piles; and in another aspect to a method of cutting precast concrete piles. This Application is a continuation-in-part of U.S. application Ser. No. 331,958, filed Apr. 3, 1989, now abandoned.

BACKGROUND OF INVENTION

Most larger buildings today are constructed using precast concrete piles. Typically these concrete piles are hexagonal in cross section and have lengths varying from 20 to 80 feet (6 to 24 meters), they have diameters of 12, 14 and 16 inches (305, 355 and 405 mm, nominal), between opposed flat faces, between opposed angles the distances are approximately 15, 17 and 19 inches, and weigh between 1.28 and 9.10 (short) tons (1.16 to 8.255 metric tonnes). Reinforcing metal strands, typically six in number, extend longitudinally of the pile, with a spirally wound reinforcing rod outside the longitudinal reinforcing strands.

Although the piles themselves have considerable compressive strength, the concrete only has about 35 MPa (about 5000 psi) lateral strength. After the piles have been driven into the ground they are cut off at about grade level, to provide support for a building, a floor or a concrete slab. After cutting, the top of the cut piles are pulverized to remove the concrete, while retaining the metal reinforcement intact, to allow for pouring of concrete or cement around the reinforcement. The amount of the pile which is pulverized is typically 18 inches (46 or so cm), and may be varied to comply with building codes. The piles cannot be cut to the proper size before they are driven. The piles must be cut after being placed.

Common methods of cutting piles at grade level involve the use of hydraulic concrete breakers, typically mounted on a hydraulically equipped backhoe or other construction vehicle. Alternatively circular saws, and blasting are used. Hydraulic concrete breakers tend to split the piles below grade level. The proportion of piles damaged by splitting is typically between about 1 damaged pile in 4 (25%), and about 1 damaged pile in 15 (approx. 7%). In some cities this method is not allowed by the building code. Blasting techniques to trim or cut off the top of the pile to grade level, or the use of jack hammers (pneumatic drills), are both dangerous to personnel and economically costly. None of the current methods are entirely satisfactory, and all are very costly.

It is a principal object of the invention to provide a device specifically intended to cut precast concrete piles. A further principal object of the invention is to provide an improved method of cutting precast concrete piles. Other and further objects will become apparent to those skilled in the art from the specification, claims and drawings.

DESCRIPTION OF THE PRIOR ART

Hydraulic stone cutting devices are known, but are not structured for cutting precast concrete piles. Typically hydraulic cutters have paired vertically opposed knives. Such devices are taught in Canadian Patent 167,684 issued to Stroud, Feb. 16, 1916, U.S. Pat. No. 2,808,822 issued to Celapino, Oct. 8, 1957, U.S. Pat. No. 2,819,710 issued to Mangis, Jan. 14, 1958, Austrian PS 215,878 issued to Kubalek, Jun. 26, 1961, U.S. Pat. No. 3,392,719 issued to Clanton et al, Jul. 16, 1968, Canadian Patent 909,672 issued to Mangis, Sep. 12, 1972, U.S. Pat. No. 3,727,600 issued to Schlough, Apr. 17, 1973, German OS 2,219,134 issued to Montoli, Apr. 19, 1973, and German OS 3,122,848 issued to Treutle, Jan. 5, 1983. None of these devices are suitable for cutting piles horizontally.

U.S. Pat. No. 3,491,811 issued to Larson, Jan. 27, 1970 teaches a hydraulic single knife vertical slasher, for logs. U.S. Pat. No. 3,495,489 issued to Savory, Feb. 17, 1970 teaches a hydraulic single knife vertical cutter. Neither of these devices is suitable for cutting piles horizontally.

A hydraulic cutter for trees and logs with paired horizontally opposed knives is taught in U.S. Pat. No. 2,612,194 issued to Ingraham, Sep. 30, 1952. A hydraulic cutter for wooden piles with paired horizontally opposed knives is taught in U.S. Pat. No. 3,056,267 issued to McRee, Oct. 2, 1962. McRee indicates, without practical instruction, stronger blades could be used to cut concrete and steel. None of these devices are suitable for cutting concrete piles horizontally.

Hydraulic log splitting devices incorporating a rammer opposed to a cutting blade are known, but are not capable of cutting precast concrete piles. Typically these operate horizontally, although the cutting blade itself is often vertical. Such devices are taught in U.S. Pat. No. 4,273,171 issued to Spaulding, Sr., Jun. 16, 1981, Canadian Patent 1,142,417 issued to Denzer, Mar. 8, 1983, Canadian Patent 1,143,255 issued to Nickerson, Mar. 8, 1983, U.S. Pat. No. 4,641,694 issued to Rohde, Feb. 10, 1987, and Canadian Patent 1,219,789 issued to Wirsbinski et al, Mar. 31, 1987. None of these devices is suitable for shearing or cutting precast concrete piles.

A specific pile breaking device is taught in International Construction, September 1988 issue, page 52. This device has four pairs of opposed hydraulically driven knives or cutters. This device would appear to function by shattering the top of the pile rather than cutting or shearing action. The device is also crane mounted, and thus not very practical for cutting precast concrete piles. U.S. Pat. No. 4,124,015 issued to Isaksson Nov. 7, 1978, teaches a closely similar arrangement of hydraulically operated cutters. U.S. Pat. No. 4,197,828 issued to Schellhorn, Apr. 15, 1980, teaches a hydraulic crane borne device which has upper shear and lower anvil members, which fit the top of a reinforced pile, the shear member is rotated with respect to the anvil member crushing the upper pile and leaving the reinforcement intact. Netherlands 8400404 issued Sep. 2, 1985, teaches a radial arrangement of hydraulically operated chisels for a concrete pile. These devices are typically about 30 to 40% efficient, in the sense that they can only cut around 30 to 40% of the piles on a site. These devices require a gap of sufficient size between neighboring piles to insert the device around the pile. When clusters of piles are driven together, the gap between piles is usually a minimum of about 13 to 15 inches, as it is the gap between the pile and an existing building. The pile driver hammer is about 16 inches across with a surrounding sleeve some 13 inches thick, which limits how close piles can be driven to each other or an existing building.

The cutting of reinforced concrete piles has two requirements. First is to shear the top at a first desired level, including shearing the reinforcements. Second is to remove the top above a second lower desired level, without damaging the reinforcements.

The requirements for a pile and reinforcements cutting or shearing device are quite restrictive, when the reinforcements must be sheared. A system of paired opposed cutter blades will only work if both blades move towards each other at equal rates, which prevents lateral stress on the pile. Lateral stress on the pile tends to cause the pile to split at or below grade level. Split piles are unacceptable under building codes.

The approach with one fixed cutter blade and another opposed moving cutter blade has the same disadvantage. The moving blade tends to push the pile sideways, creating lateral stress, and consequent possible pile splitting at or below grade level. Two versions were considered a fixed stop with a moving cutter, and a fixed cutter with a moving stop, for reinforced piles.

The fixed cutter with a moving stop has the same disadvantage as the fixed cutter opposed to the moving cutter, only more so. The pile is necessarily pushed sideways creating lateral stress which may cause damage or splitting to the pile. This lateral stress on the pile can in theory be overcome by moving the entire cutter to eliminate stress. In practice this introduces unnecessary complication into the device.

Any lateral stress tends to split the pile below grade level, in the same way as the hydraulic concrete breaker. When a pile is damaged by splitting, another pile should be driven as a substitute.

This left the single moving cutter blade with a fixed stop as the best alternative for shearing the pile and reinforcements. The stop merely has to withstand the pressure of the pile against it, and so only has to be strong enough to do so. The stop should be small enough to be inserted between adjacent piles, which can be fairly close together in groups. It should also be removable for the same reason, i.e. to allow entry of the cutter into areas of crowded piles.

Slightly different criteria apply to a device for removing the concrete without shearing the reinforcements.

DESCRIPTION OF THE INVENTION

The invention is basically a hydraulic concrete pile cutter.

The term "mild steel" as used herein refers to commonly available steel of least hardness, typically having yield strength of up to about 40,000 psi, and tensile strength of up to about 70,000 psi. The term "hard steel" as used herein refers to all grades of steel harder than mild steel, especially those suitable for use as tool steels, tool die steels, including carbide steels and carbide tipped steels, for example tungsten carbide tipped steels. As will be understood by those skilled in the art a wide variety of suitable hard materials including but not limited to the above noted steels may be utilized in the cutting edge of the device.

The cutter blade does not have to be particularly strong as typical piles only have a lateral strength of 35 Mpa (about 5000 psi). This strength is not significantly stronger than poured concrete pathways or roads. The cutting edge of the blade is advantageously be made of very hard material, as this will lengthen its working life. Softer materials will wear out faster, and often too fast to be practical. Economically the material for the cutting edge is hard steel, of the type referred to as tool steel or tool die steel. The cutting edge can also be made from tool carbides, including for example tungsten (wolfram) carbide, WC. Even harder materials may be used. In practice even mild steel may be used for the cutting edge of the blade, although this has a short working life. A mild steel cutting edge may be used perhaps once or twice with resharpening, before the blade becomes too short for the stroke of the cylinders to cut the piles through. A mild steel blade is not economic, as the cost of cutting a single pile would exceed any reasonable competitive charge for doing so.

A mild steel blade (edge) can cut the concrete, which tends to split fairly rapidly across the pile as the cutter blade edge penetrates into the concrete. Wear on the mild steel blade is caused by the high tensile steel cable reinforcements in the pile. Twelve steel type materials were tested as the blade, starting at mild steel and proceeding to heat treated ULTIMO 6 (T.M.) steel. ULTIMO 4 (T.M.) steel was found too hard to machine into blade form before heat treatment.

Applicant has, by experiment, determined that in practice it is desirable that the cutter blade edge be sufficiently hard so as not to be damaged by cutting the high tensile steel pile reinforcements. As those skilled in the art will appreciate the necessary level of hardness is a function of the dimension, structure and properties of the reinforcements present in the pile, which have considerable variation. In practice applicant has applied up to 372,000 lbs pressure (186 short tons) to cut the 6 high tensile steel cables in a precast reinforced concrete pile. Applicant considers that the blade edge in practice should desirably be harder than any reinforcements, in the sense of being able to sever the reinforcements without any noticeable wear.

In a first broad aspect the invention is directed to an improved cutting apparatus for shearing a reinforced concrete pile and reinforcements therein at a predetermined height including frame means, the frame means having a rear cross member, parallel spaced apart channel members having first and second ends, and demountable transverse anvil means, the first ends of the channel members being operatively associated with the rear cross member frame means, the second ends of channel members being operatively associated with the demountable transverse anvil means, cutter blade means extending between the channel members and being slidable therein between a first retracted position and a second extended position, the second extended position being adjacent the transverse means, hydraulic ram means operative associated with the rear cross member and the cutter blade means, whereby a concrete pile between the anvil means and the cutter blade means can be cut by moving the cutter blade means from the first position to the second position, the improvement comprising the cutter blade means being an integral plate having a double beveled knife edge extending between the channel members, the edge having a Rockwell C hardness between about 40 and about 56. Preferably the hydraulic ram means includes paired hydraulic cylinder means and the transverse anvil means is demountably attached to the channel members by removable bolts extending through aligned holes in the channel members and the transverse anvil means. The removable bolt size is not critical as long as they are capable of withstanding the shearing stress, in fact bolts of 1.5 inch diameter and grade 8 steel were employed. The edge is preferably of Rockwell C hardness between about 50 and about 56, more preferably of about Rockwell C hardness 56. In practice a variety of increasingly hard steels were tested. 4140 steel, KEEWATIN (T.M.) steel and ULTIMO (T.M.) steel were tested, the steels were also tested in heat treated form. Extremely hard steels are too brittle for this sort of use. It was also found that it was more convenient to machine the metal then heat treat it. In the case of ULTIMO, it was also found difficult to machine the metal before heat treatment.

The above hardness limits may apply to the entire plate, or may be limited to the effective cutting edge of the plate. When an integral plate is used it is usually more convenient to heat treat the entire plate, rather than the cutting edge portion.

The blade must be thick enough or rigid enough not to buckle, a single plate with a thickness of at least 1 inch is suitable, with 1.25 inch preferred. The cutting edge is a front beveled portion forming a knife edge. A scissor style cutting edge is unsatisfactory tending to edge up and down rather than sliding in smoothly and horizontally. This scissor style blade tends to smash fairly rapidly (3 to 5 uses). The front edges of the blade should fill the channels as otherwise dust and the like accumulates in the channels, a clearance of 0.0625 inch was found satisfactory.

The distance between extended and retracted positions is the stroke of the hydraulic ram, in theory 16 inches (41 or so cm) is sufficient, but as would be appreciated by those skilled in the art, this distance is critical as the hydraulic ram stroke must be greater than the largest pile to be cut. The blade must be at least as long as the stroke to cut through the pile. In practice the stroke is advantageously at least 2 inches (5 cm) greater than the largest pile to be cut, and a 20 inch (51 cm) stroke is preferred. As would be understood by those skilled in the art, the length of the stroke can be changed to adapt to circumstances. As would also be understood by those skilled in the art, the dimensions of the device can similarly be varied.

The anvil gate must be of sufficient strength to withstand the pressure applied to it. 1 inch mild steel has a tendency to buckle, 3 inch mild steel was found satisfactory, 5.25 inches CHT 100 steel was employed, sandwiched between two angle irons. As would be appreciated by those skilled in the art, the dimensions of the anvil are not critical as long as the strength is sufficient. The anvil is demountably attached to the channel members.

The rear cross member and parallel channel members are preferably formed of top and bottom angle irons with a sandwich of CHT 100 steel. The channels are preferably lined top and bottom with CHT 360 steel to prevent wear and buckling. In the cutting zone, the channels are preferably further reinforced by more CHT 100 steel top and bottom. The dimensions of both channel and blade may be altered as would be appreciated by those skilled in the art.

The preferred hydraulic ram has paired hydraulic cylinders providing a higher, more uniform pressure, and resulting in the blade having much less tendency to jam. Multiple hydraulic cylinders can be used, but two cylinders are a simple and convenient variation, providing the device with maneuverability and compactness, as well as negligible jamming.

In a second aspect the invention is directed to an improved method of shearing reinforced concrete piles and the reinforcements therein at a predetermined height by a cutting apparatus the cutting apparatus comprising a single cutting edge of double beveled knife form, the improvement comprising the cutting edge having a hardness of about 40 to about 56 Rockwell C. Preferably the edge is of Rockwell C hardness between about 50 and about 56, more preferably about 56.

Testing hydraulic cylinders showed paired versions worked better, severing the pile more smoothly. Paired 5 inch cylinders at standard hydraulic pump pressure of 3,000 psi would shear a 12 inch pile, with the usual 0.4375 inch steel reinforcements. When paired 8 inch cylinders were employed in testing at hydraulic pressures of 1,800 psi up to 2,800 to 3,500 psi, with positive results. When 8 inch cylinders were employed on 12 inch piles, it was found 1,900 psi would shear the pile when 0.4375 steel reinforcements were present. 8 inch cylinders rated up to 4,200 psi, using about 3,000 psi were able to shear 16 inch piles with 0.5 and 0.625 inch steel reinforcements, pressures up to 3,800 psi were also found effective.

In a third aspect the invention is directed to a cutter blade for reinforced concrete comprising a rectangular metal plate having on one side a double beveled knife edge, the edge having a Rockwell C hardness between about 40 and about 56, preferably between about 50 and about 56, more preferably about 56.

In a fourth aspect the invention is directed to a method of cutting reinforced concrete comprising cutting the concrete with a rectangular metal plate having on one side a double beveled knife edge, the edge having a Rockwell C hardness between about 40 and about 56, preferably between about 50 and about 56, more preferably about 56.

In a fifth aspect the invention is directed to a cutter blade for shearing a reinforced concrete pile comprising a rectangular metal plate having on one side a single beveled cutting edge having a thickness of about 0.125 inch, the cutting edge having a tensile strength of at least about 70,000 psi, the cutting edge comprising a reentrant of similar shape to, and smaller than, the perimeter of the pile. The reentrant is designed to fit the pile but about 4 inches smaller, 2 inches on either side, sufficient to penetrate and shear the concrete, but not the steel reinforcements. The concrete splits through, without damaging the steel reinforcements. Preferably the edge has a Rockwell C hardness of between 35 and 45, more preferably about 40. The material must be hard wearing rather than hard and mild steel is not hard wearing enough, harder material is used. The cutting edge is about 0.125 inch, thicker, 0.25 inch, tends to damage the pile rather than shearing it, thinner, 0.0625 inch, tends to crumple. This blade must be thick enough to withstand the pressure applied during use, a single plate with a thickness of at least 1 inch is suitable, with 1.25 inch preferred. Usually the pile is hexagonal in cross section and the reentrant is similarly hexagonal, as would be realized by those skilled in the art, piles with other cross sections would require different reentrants.

The above hardness limits may apply to the entire plate, or may be limited to the effective cutting edge of the plate. When an integral plate is used it is usually more convenient to heat treat the entire plate, rather than the cutting edge portion.

In a sixth aspect the invention is directed to a method of shearing a reinforced concrete pile, while leaving its reinforcements intact, comprising shearing the concrete pile at a predetermined height to a depth less than that required to shear the reinforcement with a cutter blade comprising a rectangular metal plate having on one side a single beveled cutting edge having a thickness of about 0.125 inch, the edge having a tensile strength of at least about 70,000 psi, the cutting edge comprising a reentrant of similar shape to and smaller than the perimeter of the pile. Preferably the cutting edge has a Rockwell C hardness of between 35 and 45, more preferably about 40. When the pile is hexagonal in cross section the reentrant is similarly hexagonal.

In a seventh aspect the invention is directed to a cutting apparatus for shearing a pile, having concrete and reinforcements, at a predetermined height comprising frame means, the frame means having a rear cross member, parallel spaced apart channel members having first and second ends, and demountable transverse anvil means, the first ends of the channel members being operatively associated with the rear cross member, the second ends of channel members being operatively associated with the demountable transverse anvil means, first and second cutter blade means having opposed cutting edges extending between the channel members, the second cutter blade means being adjacent the anvil means, hydraulic ram means operative associated with the rear cross member and the first cutter blade means, the first cutter blade means being slidable in the channel means between a first retracted position and a second extended position, the second extended position being adjacent the second cutter blade means, the first and second cutter blade means each comprising a rectangular metal plate having on one side a single beveled cutting edge having a thickness of about 0.125 inch, the cutting edge having a tensile strength of at least about 70,000 psi, the cutting edge comprising a reentrant of similar shape to, and smaller than, the perimeter of the pile, whereby a reinforced concrete pile between the first and second cutter blade means can be sheared leaving the reinforcements intact, by moving the first cutter blade means from the first position to the second position. Preferably the cutting edge has a Rockwell C hardness of between 35 and 45, more preferably about 40. When the pile is hexagonal in cross section the reentrant is similarly hexagonal.

In a eighth aspect the invention is directed to a method of shearing a reinforced concrete pile leaving its reinforcements intact comprising shearing the concrete pile at a predetermined height to a depth less than that required to shear the reinforcement with opposed cutter blades, each comprising a rectangular metal plate having on one side a single beveled cutting edge having a thickness of about 0.125 inch, the edge having a tensile strength of at least about 70,000 psi, the cutting edge comprising a reentrant of similar shape to and smaller than the perimeter of the pile. Preferably the cutting edge has a Rockwell C hardness of between 35 and 45, more preferably about 40. When the pile is hexagonal in cross section the reentrant is similarly hexagonal.

Additionally the reentrant cutter blade may have a metal projection affixed to the blade and projecting toward the cutting edge. In the double cutter cutting apparatus there can be first metal projection means affixed to the first cutter blade means projecting toward its cutting edge, and second metal projection means affixed to the anvil and projecting over the second cutter blade means toward its cutting edge, whereby a reinforced concrete pile is additionally shattered by the projections, subsequent to shearing, by moving the first cutter blade means from the first position to the second position. These projections are generally 0.5 inch angle iron affixed to the moving blade, and 0.5 inch angle iron affixed to the anvil gate, these projections may be conveniently from about 9 to about 4 inches deep, with about 6 inches deep being suitable. They project almost to the cutting edge of the reentrant, and may project slightly beyond. First the cutting edge penetrates the pile shearing and lifting the concrete slightly, these projections contact the concrete and crack and then shatter it. This effectively destroys the concrete above the cutter blades, leaving intact reinforcements. It is possible to remove the concrete in two or more cuts each about 9 to 4 inches deep, with 6 inches a convenient compromise. Deeper cuts than 9 inches are possible but do not shatter the concrete all the way to the top, leaving an unshattered top portion. This is not adequately supported by the bare reinforcements, which tend to buckle and collapse under the strain.

In a ninth aspect the invention is directed to concrete breaking means for concrete cutting apparatus comprising support plate means having front and back surfaces, projecting means extending forward of the front surface and attachment means extending rearward of the back surface. The projecting means may be wedge shaped means having base means attached to the support plate means, and the attachment means may be attachment plate means attached to and extending rearward of the support plate means. Preferably the projecting means comprises a plurality of wedge shaped means, and the attachment plate means has aperture means adapted to receive bolt means. A single projection attached to the moving blade and a single projection attached to the anvil will shatter concrete, two such projections are more effective.

The cutting apparatus may additionally include suspension means comprising first opposed paired support members attached to the spaced apart channel members adjacent the rear cross member, and second opposed paired support members attached to the spaced apart channel members adjacent the first retracted position of the cutter blade, and between the cutting edge of the (single) blade in the first retracted position and the rear cross member, the first and second opposed paired support members extending upward and inward to join spar means connecting the first and second paired opposed support members, the spar means being adapted to receive suspending means. When two cutter blades are used the second opposed paired support members are attached to the spaced apart channel members adjacent the first retracted position of the first cutter (moving) blade, and between the cutting edge of the first cutter (moving) blade in the first retracted position and the rear cross member. There are a series of apertures in the spar to attach cables and the like. The suspension means also functions as a protective cage for the hydraulic cylinders. In practice, there is only one cutting apparatus, with the blades changed between operations, and the second pair of members are placed adjacent the furthest retracted position of any cutting edge, but between it and the rear cross member.

The invention provides guide means for a cutter for hexagonal concrete piles. This cutter has a cutter blade of predetermined thickness sliding in parallel channels and opposed anvil means extending between the channels. The guide means comprises rear wall means and paired opposed diverging spaced apart side wall means adjoining the rear wall means. The side wall means are angled forward from said rear wall means at an acute angle, the rear wall means and the side wall means form recess means. The rear wall means extends between the opposed side wall means for a distance slightly greater than a side of one of said hexagonal piles. The acute angle is approximately that between successive sides of the hexagonal piles, whereby one said hexagonal pile would fit snugly into the recess means. The rear wall means fits against the anvil means between the channels, with the recess means midway of the rear wall means.

Preferably the guide means has side wall means, which each comprise first opposed portions forming a first recess, and second opposed portions forming a second recess. These first and second recesses are collinear such that a single hexagonal pile would simultaneously fit snugly into both recesses. The first and second recesses are separated by a portion of the rear wall means extending therebetween a distance greater than the thickness of the cutter blade, allowing the cutter blade can contact the rear wall means between the first and second recesses.

Applicant has found that this guide means is preferably used with the single blade cutter. Attached to the cutter anvil gate it allows the flat side of a pile to fit snugly against the back of the recess, this means that the opposing flat side is parallel to the cutter blade edge, which thus cuts evenly into the pile side. Simultaneously the guide means centers the pile within the cutter. The pile reinforcements are near the pile angles, about 2 inches or so within the pile. The blade edge cuts these in pairs when the pile side is parallel to the blade edge, and the pile is centered within the cutter, which prevents uneven progression of the blade as it cuts reinforcements first on one side then the other. Use of the guide prevents the pile being cut from angle to angle with the angle being pushed against the anvil gate and suffering damage. The guide in preferred form also braces the pile against the anvil gate and protects the pile above and below reinforcement severing blade. As would be appreciated by those skilled in the art similar guides can be made for concrete piles of other cross sectional profiles.

Applicant has also found in practice both for blade wear and cutting convenience it is advisably preferred to maintain the cutting blades and the cutter itself level or horizontal, which makes it much easier to cut the piles. The cutter should be maintained level to the same degree of accuracy as the piles are vertical.

In preferred practice the cutter is used with the single 1.25 inch cutter blade at a time to slice the top of the pile off at grade level. The single cutter blade is then removed and two reentrant blades are placed in the cutter one movable, the other fixed. These are then used to shear and shatter the concrete from the top 18 inches of the pile, leaving the reinforcements intact. As is realized by those skilled in the art any desired amount of concrete can be sheared and shattered from the top of a pile leaving the reinforcements intact.

DESCRIPTION OF PREFERRED EMBODIMENTS

Preferred embodiments are indicated in the drawings where:

Figure 1:
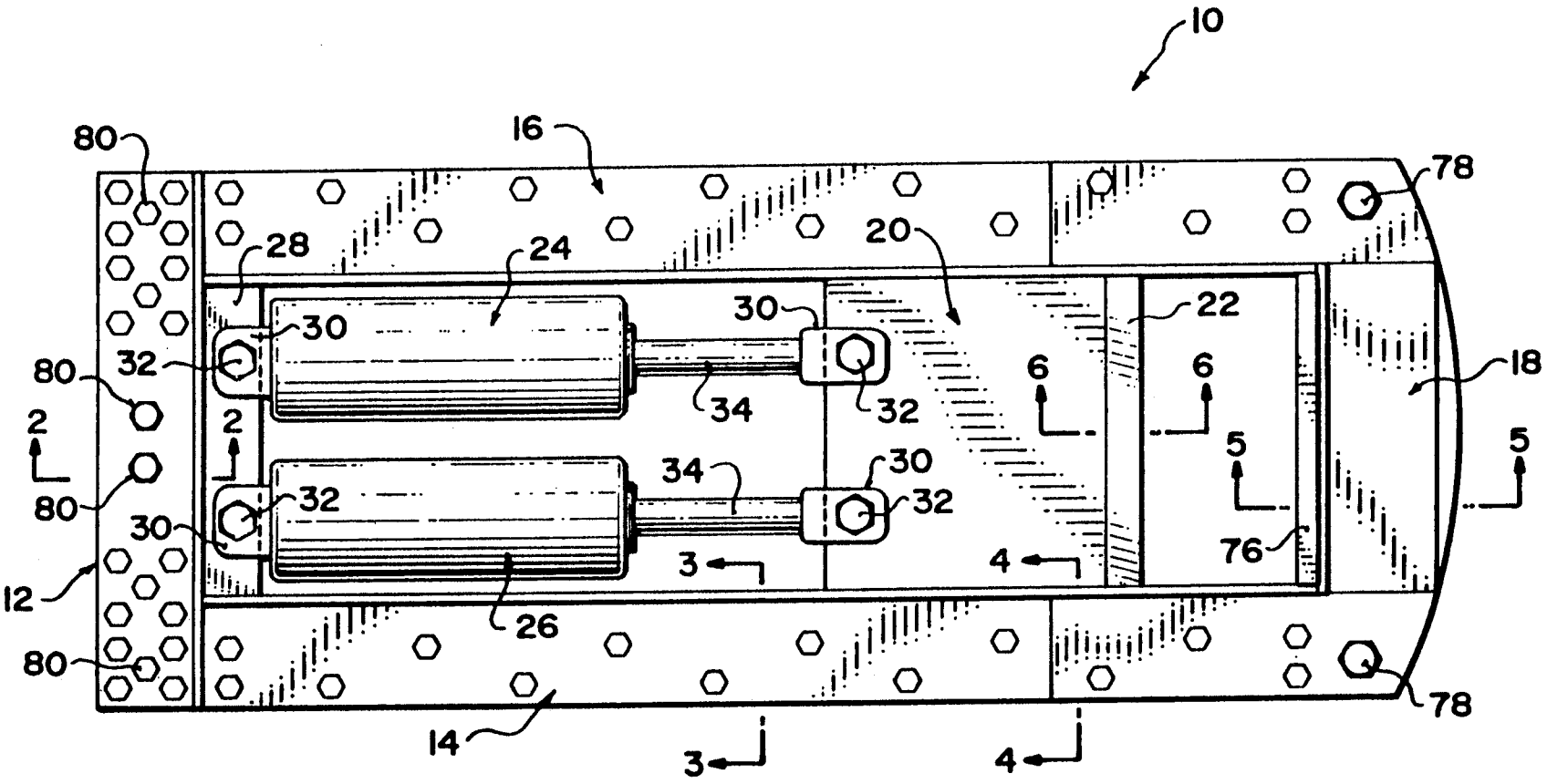
FIG. 1 is a top plan view of a first embodiment of a cutter of the invention.
Figure 2:
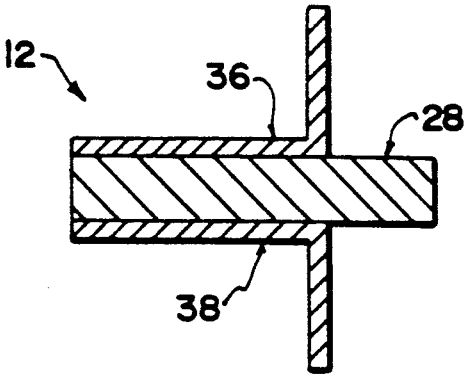
FIG. 2 is a cross sectional view of a rear cross member of the cutter of FIG. 1.

The general description of the invention is now expanded by reference to the drawings, which illustrate preferred embodiments of the invention. FIGS. 1 to 10 and, 12 to 24 illustrate preferred embodiments of the invention omitting details of hydraulics.

The cutter generally indicated by numeral 10, is adapted to cut a reinforced concrete pile and includes rear cross member 12, side channel forming members 14 and 16, and anvil gate 18, blade plate 20 including forward cutting edge 22. Hydraulic cylinders 24 and 26 are secured to plate 22 and rear support plate 28 by clevises 30 and bolts or pins 32, extensible and retractable cylinder rods 34 enable movement of the cutter blade. The cylinders are 8 inch internal diameter capable of operating up to at least about 3,500 psi, preferably rated at up to 4,200 psi, with a stroke length of at least about 18 and more preferably 20 inches.

Figure 3:
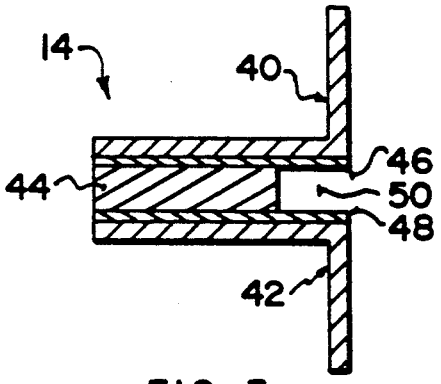
FIG. 3 is a cross sectional view of a side member of the cutter of FIG. 1.
Figure 4:
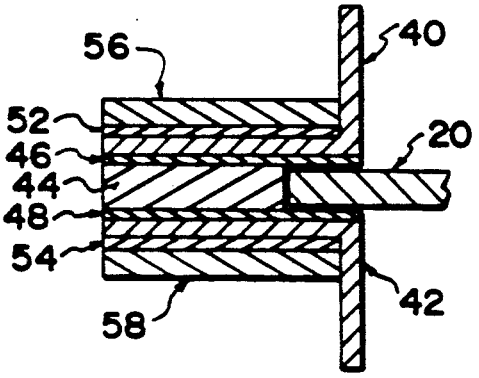
FIG. 4 is a cross sectional view of a reinforced portion of a side member of the cutter of FIG. 1.
Figure 6:
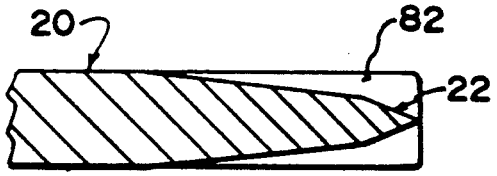
FIG. 6 is a partial cross sectional view of the blade plate of FIG. 1.
Figure 5:
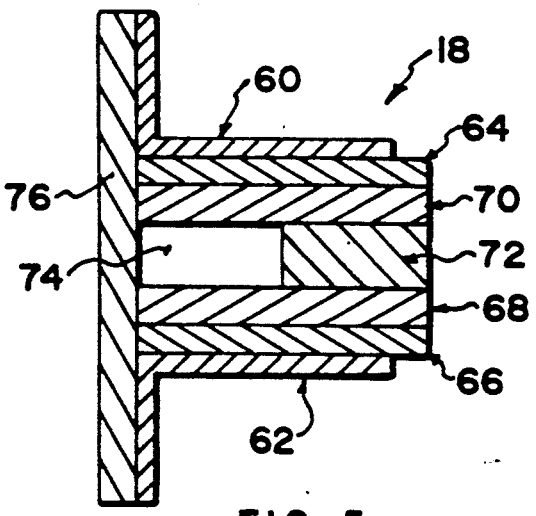
FIG. 5 is a cross sectional view of an anvil gate of the cutter of FIG. 1.
Figure 7:
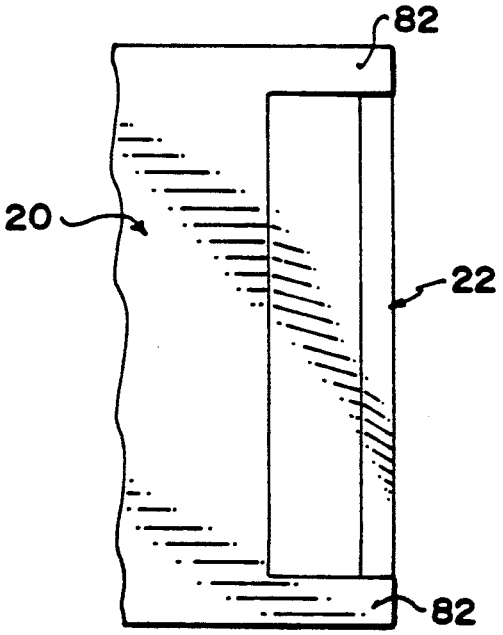
FIG. 7 is a partial plan view of the blade plate of FIG. 1.

Rear member 12 (FIG. 2) is formed by upper and lower angle irons 36 and 48 and rear support plate 28 (CHT 100 steel, tensile strength about 115,000 psi, yield strength about 100,000 psi), the angle irons are $4\times7\times0.5$ inches and extend across the rear of the device (35 inches), the rear support plate is $10\times1.75$ inches thick, and extends between the side members. Side member 14 has a rear portion (FIG. 3) comprising upper angle iron 40 and lower angle iron 42, side plate 44 (CHT 100 steel) upper and lower thin plates 46 and 48 (CHT 360 steel, tensile strength about 180,000 psi, yield strength about 165,000 psi), the side plate and thin plates form channel 50, the angle irons are $4\times7\times0.5$ inches, the upper and lower thin plates are $7\times0.25$ inches, the side plate is $5\times1.25$ inches, leaving channel 50 $2\times1.25$ inches, all extend from rear member 12 forward. Side member 14 has a reinforced forward portion (FIG. 4), which besides the elements shown in FIG. 3 shows channel 50 receiving blade plate 20, the reinforcement includes outer thin plates 52 and 54 (mild steel) 6.5×0.25 inches, and outer thicker plates 56 and 58 (CHT 100 steel), 6.5×0.75 inches, these extend some 22 inches along the forward end of side member 14. Anvil gate 18 (FIG. 5) has upper and lower angle irons 60 and 62, 7×4×0.5 inches and a set of horizontal plates 64, 66, 68, 70, 72 (CHT 100), plates 64 and 66 are 7.25×0.75 inches, plates 68 and 70 are 8×1 inches while set forward middle plate 72 is 4×1.75 inches, forming recess 74, 4×1.75 inches, all extend across the front of cutter 10 between side members 14 and 16. Anvil gate 18 has removable mild steel protective plate 76, 13.25×1 inch, on its rear face, extending the depth of anvil gate 14 and between side members 14 and 16, as a protection. Anvil gate 18 is removably secured to side members by bolts 78 which are 1.5 inch diameter grade 8 steel as are bolts or pins 32, bolts 80 are 1 inch diameter grade 8 steel, the residual bolts are 0.75 inch diameter grade 8 steel.

The cutter 20, 22×25×1.25 inch (FIG. 6) has a doubled beveled cutting edge 22, extending 21 inches between unbeveled side portions 82, 2 inches each, which enable the cutter to slide in channels 50. A clearance of 0.0625 inch is allowed above and on each side of the cutter in the channel.

The metal of the cutting edge has a Rockwell C hardness of about 45 to 56, and is ULTIMO (T.M. for heat treated steel), ULTIMO 6 was employed. Other materials were found not hard enough and strong enough for prolonged sustained use, while heat treated KEEWATIN (T.M) and 4140 steel were hard enough for cutting purposes they did not hold up under prolonged testing. The blade was tested at a Rockwell C hardness measured at 46, and found to be satisfactory except for the most heavily reinforced commonly available piles, with ⅜th inch reinforcements, where minor wear was noted. The blade was heat treated to a Rockwell C hardness measured at 54 with the cutting edge of Rockwell C hardness measured at 56. This blade was tested on the same piles, without noting any wear. Applicant has been unable to discover precise details of these heavily reinforced piles. Rockwell hardness 55 corresponds in a very notional sense to a tensile strength of about 285,000 psi. In use cutter 10 is levelled about the pile to be cut, cutting edge 22 is then pushed through the reinforced concrete pile until it nearly reaches plate 76, this severs the top of the pile, reinforcements included.

The double beveling of edge 22 was found advisable, because single beveled blades tend to distort upwards or downwards and develop cracks in the middle portion. Single beveled blades were noted to start distortion and begin to crack after three to five uses. An integral blade plate was found superior to a pusher plate with detachable cutting edge as the cutting edge tends to detach during use.

Figure 8:
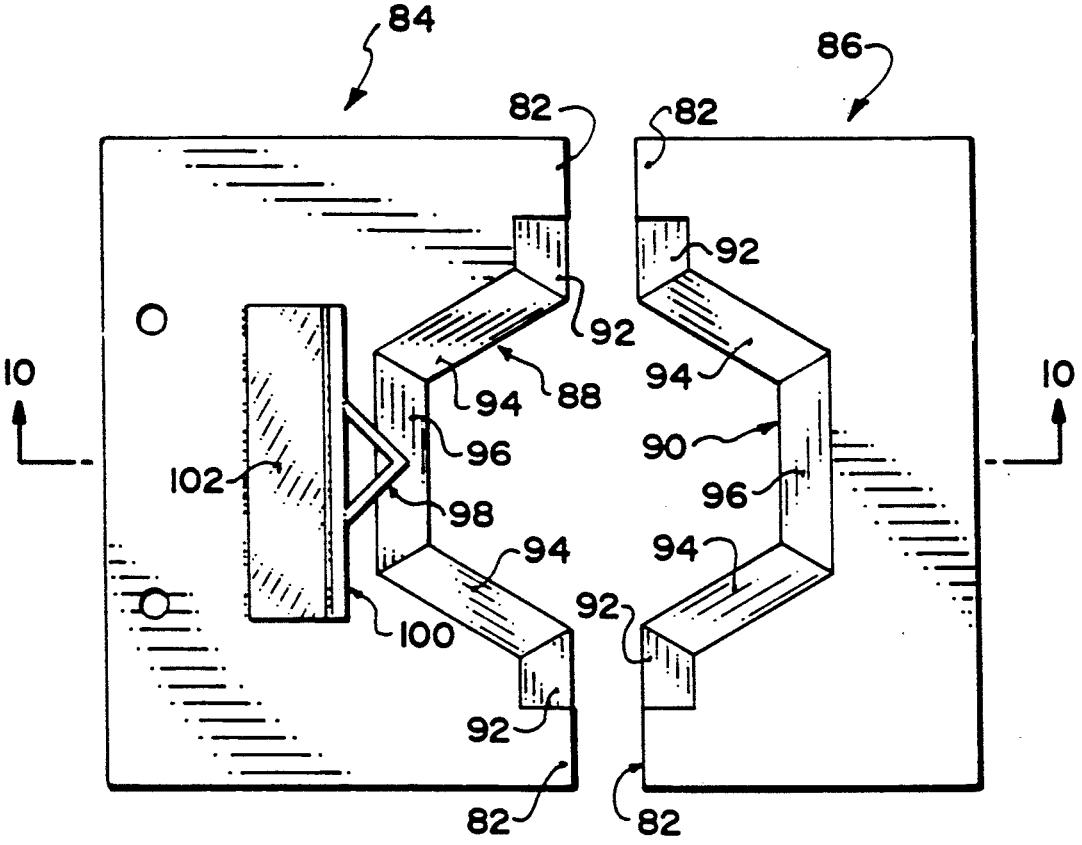
FIG. 8 is top plan view of a blade plate of a second embodiment of the invention.
Figure 9:
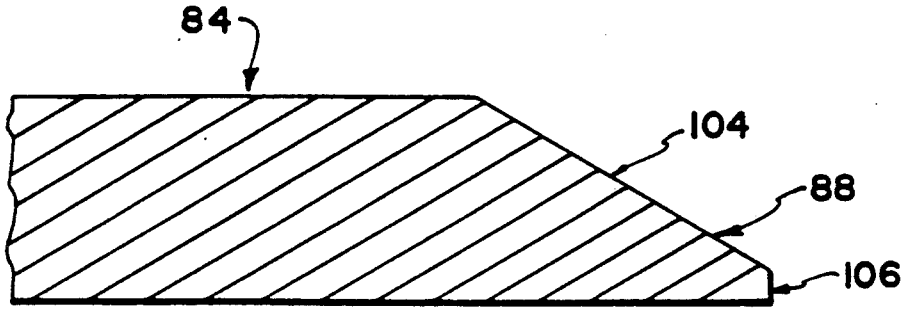
FIG. 9 is a partial sectional view of a blade plate of FIG. 8.
Figure 10:
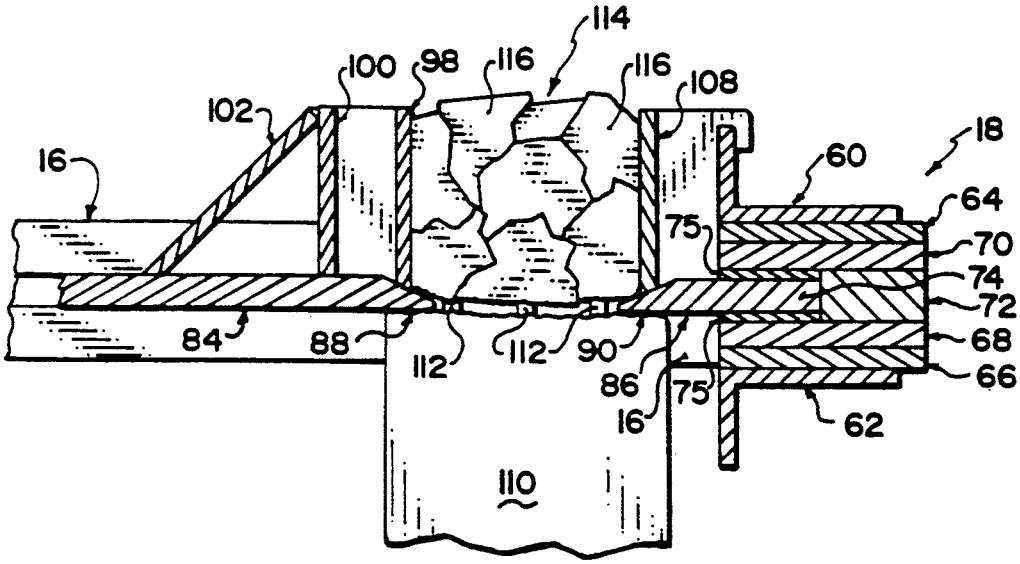
FIG. 10 is a partial sectional view of a cutter employing a blade plate of FIG. 8.

A second embodiment otherwise identical to that of FIG. 1, employs the cutter blade system of FIG. 8, which includes opposed moving cutter blade 84 and fixed cutter blade 86. Moving cutter blade 84 is a rectangular plate with a beveled cutting edge 88 between unbeveled side portions 82, fixed cutter blade 86 similarly has a beveled cutting edge 90 between unbeveled side portions 82. Each cutting edge has outer beveled cutting sectors 92, adjacent, and collinear with, unbeveled plate portions 82. Inside cutting sectors 92 are beveled angled cutting sectors 94, which are angled into the plate at 60, between sectors 94 is beveled cutting sector 96, which is parallel with cutting sectors 92. The cutting edges of sectors 94 and 96 form half of a regular hexagon. Projecting angle iron 98 is vertically in the middle of cutting sector 96 of blade plate 84. It is part of detachable structure 160, which includes back plate 100, and bottom plate 144, which can together be an angle iron, reinforced by gussets 146, 148 and 150, bolts passing through bottom plate 144 secure 160 to blade 84. Optionally projection 102 is prenysent on blade 84 to allow positioning of structure 160. Moving cutter blade 84 has paired holes 85, to receive pins or bolts 32 to secure the cutter blade to clevises 30. Fixed cutter blade 86 has optional paired holes 87 to receive similar pins or bolts 89 passing through anvil gate 18, as shown in FIG. 10, neither the dimension of holes 87 or pins 89 are critical as they are intended to prevent fixed cutter blade 86 from sliding out of position during maneuvering.

Three forms of the plate blade system are contemplated, each adapted to a particular size of hexagonal pile. The blades are uniformly 25 inches across, cutting sectors 92 have cutting edges of 2.5 inches. When the pile is 16 inches in diameter, plate 84 is 15.75 inches from front to back, plate 86 is 13.25 inches from front to back, cutting sectors 92 are 14 inches apart, while cutting sectors 96 are recessed 6.25 inches from cutting sectors 92. When the pile is 14 inches in diameter, plate 84 is 16.75 inches from front to back, plate 86 is 12.25 inches from front to back, cutting sectors 92 are 12 inches apart, while cutting sectors 96 are recessed 5.25 inches from cutting sectors 92. When the pile is 12 inches in diameter, plate 84 is 17.75 inches from front to back, plate 86 is 11.25 inches from front to back, cutting sectors 92 are 10 inches apart, while cutting sectors 96 are recessed 4.25 inches from cutting sectors 92.

Cutting edge 88 (FIG. 9) has a downward bevel 104, angled at about 30 to the horizontal terminating in a vertical tip 106. Cutter plate 84 (and 86) are 1 to 1.25 inches thick, bevel 104 extends about 2 inches horizontally from tip 106. The vertical tip is 0.125 inch, which is a highly desirable dimension, thinner tips, for example 0.0625 inch, crumple rather than cutting, while thicker tips, for example 0.25 inch, do not cut the pile efficiently, and also tend to damage the pile too much as it is cut, by breaking rather than shearing. The blade plates 84 and 86 are preferably boron steel 15B30 heat treated to Rockwell C hardness 43 to 50, which is notionally equivalent to tensile strengths of about 200,000 to 245,000 psi. CHT 350 steel, which is rated about 170,000 psi tensile strength, may be also utilized.

In use (FIG. 10) blade plate 84 replaces blade plate 20, while blade plate 86 is slid into channels 50, protective plate 76 is removed from anvil gate 18, which is then closed and secured, the forward (non-cutting portion) of blade 86 is within recess 74 contacting plate 72, where it may be shimmed by plates 75, these plates may be a permanent fixture of recess 74. When present these plates are CHT 360 steel, and 0.25×4 inches extending across anvil gate 18. Angle iron 108 is removably placed on top of blade plate 86, affixed to anvil gate 18. The cutter is then placed around pile 110, blade plate 84 is actuated. At first blade 84 moves against pile 110, with cutting edge 88 beginning to shear pile 110, the cutter self rights itself bringing blade 86 into contact with the pile. Then cutting edges 88 of blade plates 84 and 86 shear and move into the pile. This then splits across as edges 88 penetrate the concrete without severing reinforcements 112. Angle irons 98 and 108 then press the outer edges of severed pile top 114, shattering the concrete of this pile top 114, into fragments 116, without damaging the reinforcements 112. Edges 88 stop advancing when blade side portions 82 meet, at which point they have penetrated approximately the horizontal length of bevel 104 (about 2 inches) into the pile. Optional pins 89 extending through holes 87 anvil gate 18 secure fixed cutter blade 86 in position, in the sense that they prevent blade 86 from sliding out of position, when the cutter is moved, unlike pins or bolts 32 they do not have to resist pressure.

Figure 12:
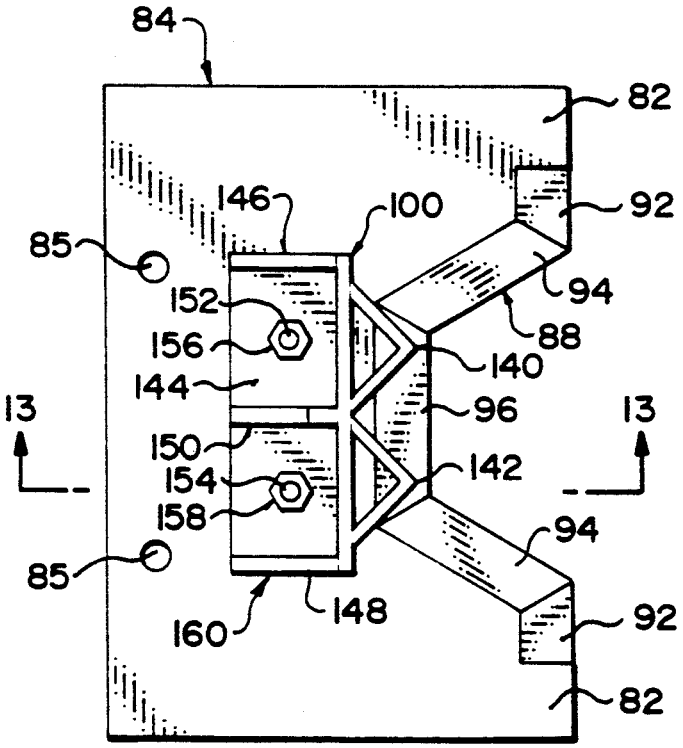
FIG. 12 shows an alternative embodiment of the moving cutter blade of FIG. 8.
Figure 13:
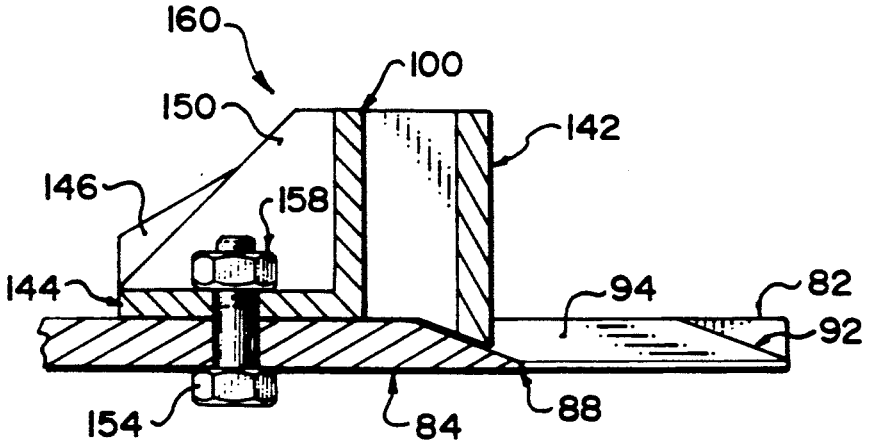
FIG. 13 shows a partly sectional side view of the embodiment of FIG. 12.

Another removable projection for moving blade 84 is shown in FIGS. 12 and 13. In this form double angle irons 140 and 142, both 3×3×0.5 inches, are welded to back plate 100, which is 0.5 inches thick and 10 or 11 or 12 inches wide, back plate 100 is welded to bottom plate 144, also 0.5 inches thick and 10 or 11 or 12 inches wide, back plate 100 and bottom plate 144 may be an angle iron. Side gussets 146 and 148 and mid gusset 150 are welded to back plate 100 and bottom plate 144, to provided support to, or buttress, angle irons 140 and 142. Gussets 146, 148 and 150 are conveniently about 0.5 or 0.625 inch thick, with the latter preferred. Back plate 100 and bottom plate 144 preferably are the conjoined flanges of a suitable sized angle iron. This structure 160, is detachable from cutter plate 84. Bottom plate 144 is secured to cutter plate 84, by bolts 152 and 154 and nuts 156 and 158. Angle irons 140 and 142 extend down to the front of cutting edge 88 of cutter blade 84, and may be from about 4 to 9 inches deep, with 6 inches being suitable. In this instance angle irons 140 and 142 are indicated as nearly touching. This configuration is preferred for use on 12 inch piles. The removable structure 160 is used with different cutter blades 84.

Figure 15:
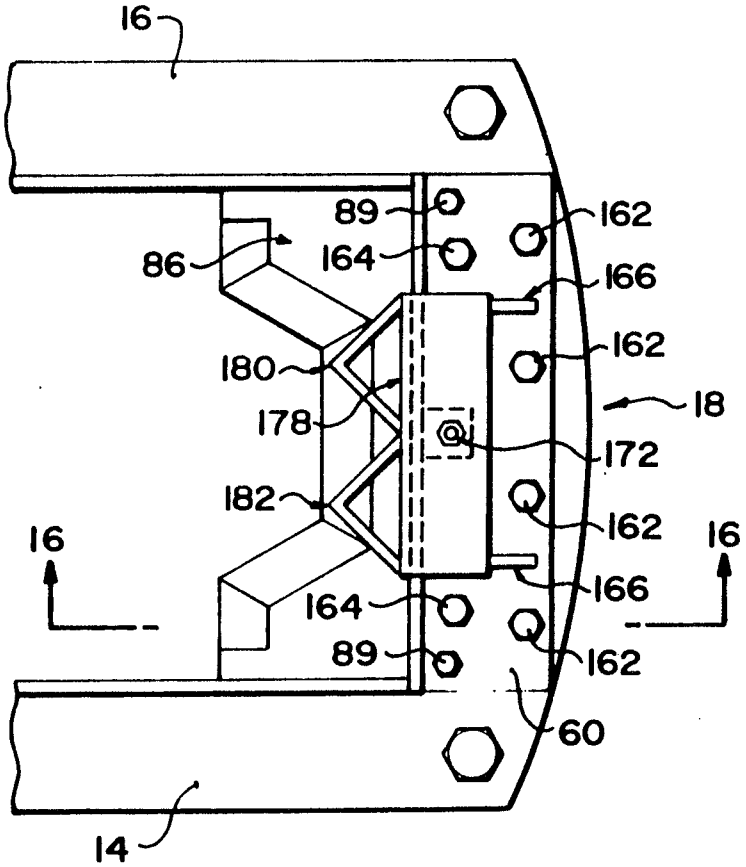
FIGS. 14 and 15 show top views of an alternative embodiment of the gate structure of FIG. 1, with and without a detachable projection.
Figure 14:
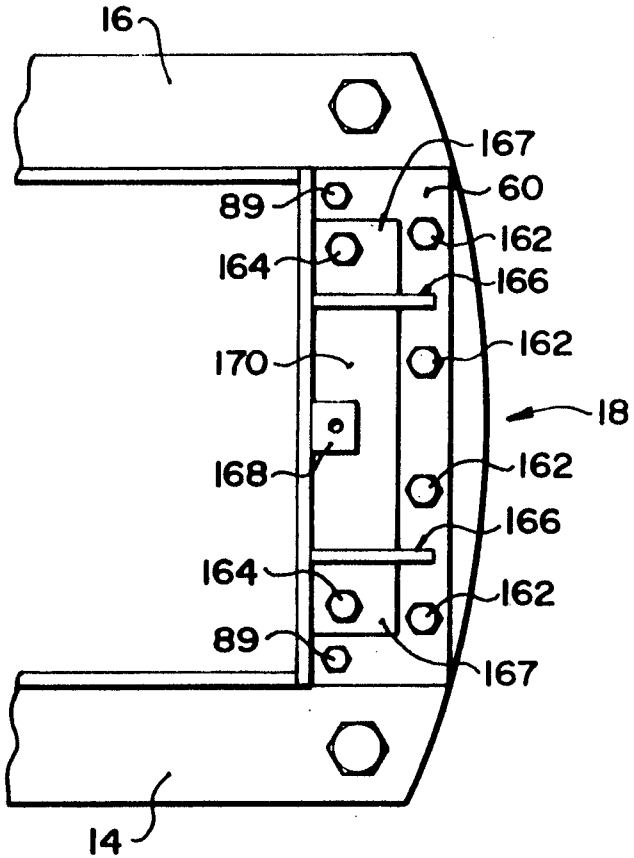
Figure 16:
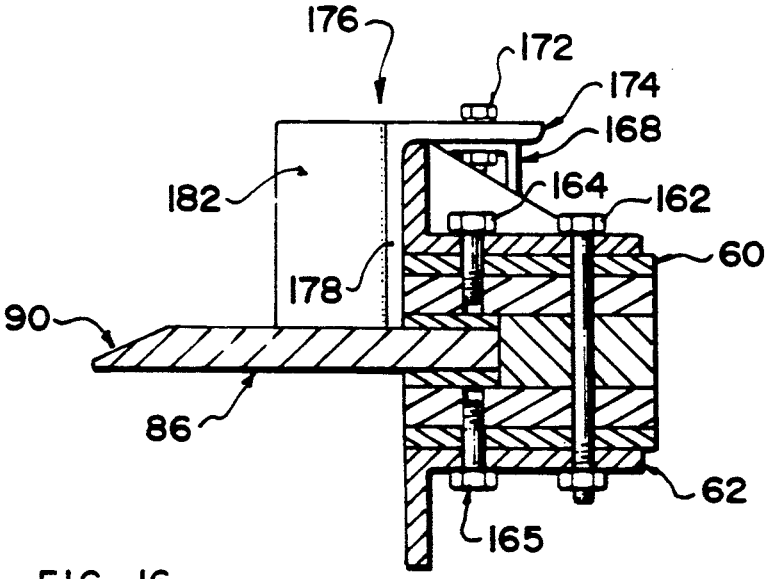
FIG. 16 shows a part sectional side view of the embodiment as shown in FIG. 15.

In FIGS. 14 to 16 is shown an alternative embodiment of gate 18, angle iron 60, either 4×7×0.5 inches, or more preferred 4×7×0.75 inches, and about 22 inches across, is secured to gate 18 by four bolts 162 which pass through the gate to be secured by nuts, and two bolts 164, which engage threads within the gate, pins 89 are indicated. Paired lower bolts 165 similarly secure lower angle iron to gate 18. Two 0.5 inch gussets 166 are welded to 60 providing extra strength, optional strengthening plate 167 extends underneath, and between and beyond gussets 166. A small angle iron 168 supported by welded plate 170 provides a support for a nut and bolt 172 to secure top plate 174 of structure 176 to the gate. When fixed cutting blade 86 is present structure 176 is attached to the gate it has top plate 174, back plate 178 and angle irons 180 and 182, all welded to each other. In this case there is a gap of about 1 inch between the angle irons, this configuration is preferred for 14 inch and 16 inch piles. Strengthening of the upper angle iron 60 is desirable because of a tendency to distort upward during repeated use.

Figure 17:
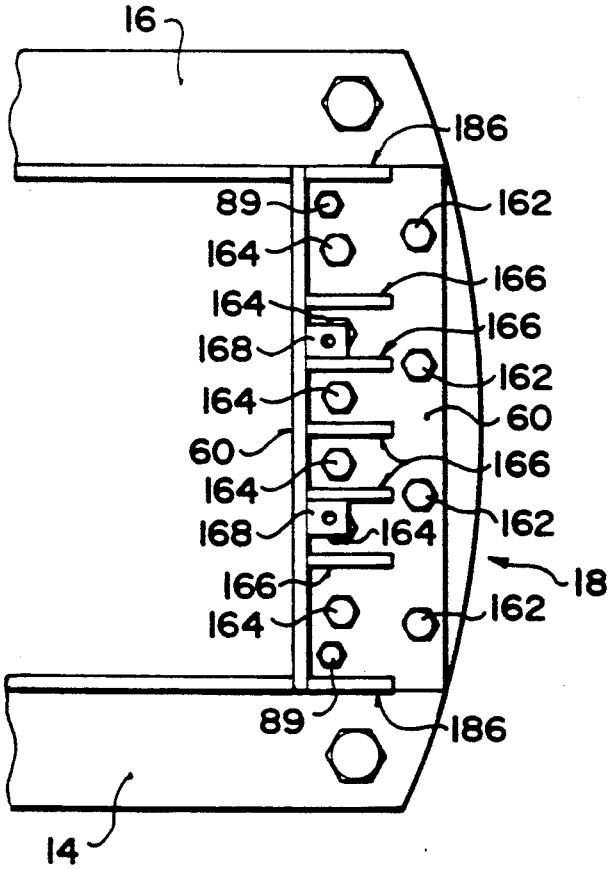
FIG. 17 shows a top view of another embodiment of the gate structure of FIG. 1.
Figures 18, 19:
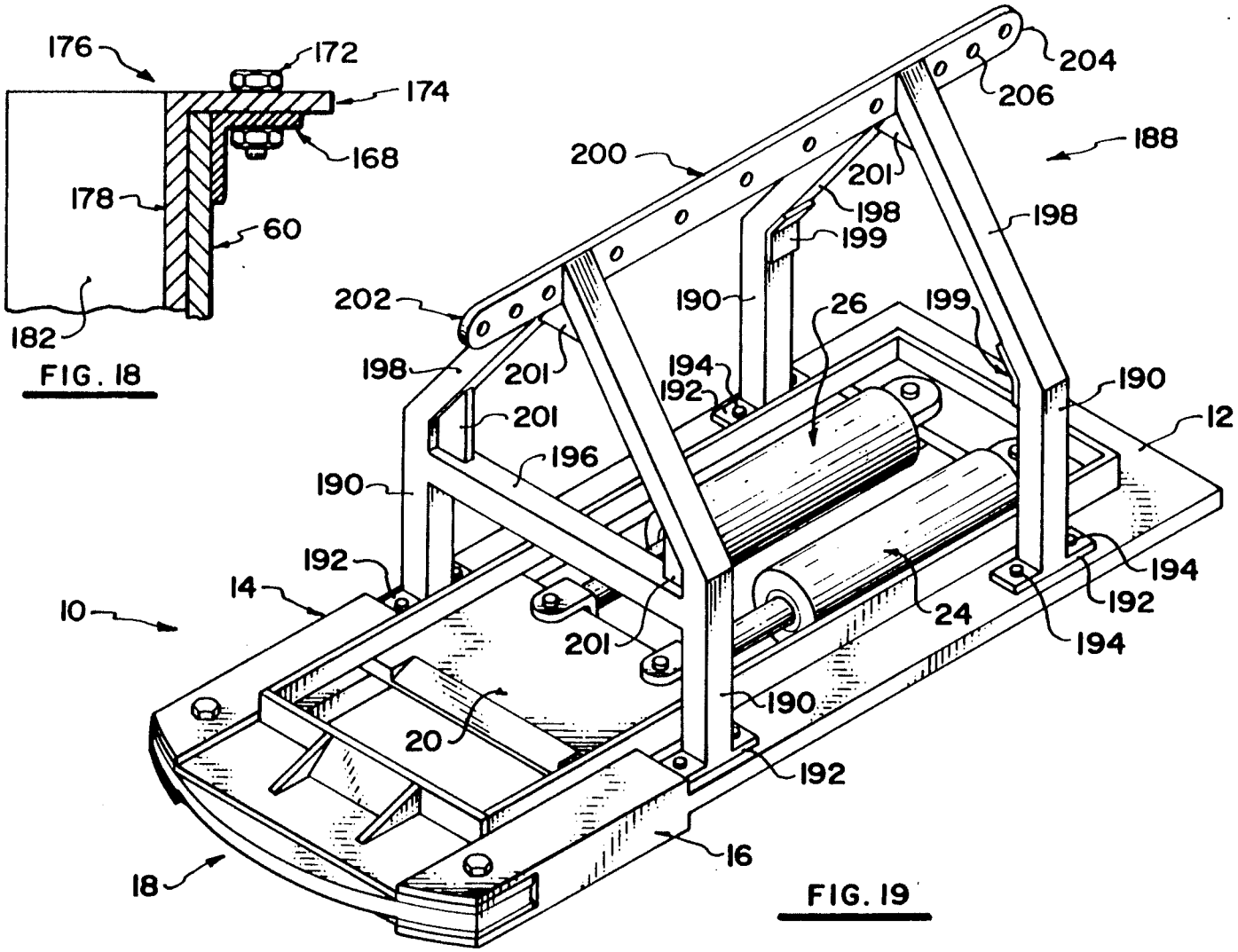
FIG. 18 shows a sectional side view of a detail of FIG. 17 with attached projection.
FIG. 19 shows a perspective view of an embodiment of the invention further including a protecting suspending frame.
Figure 20:
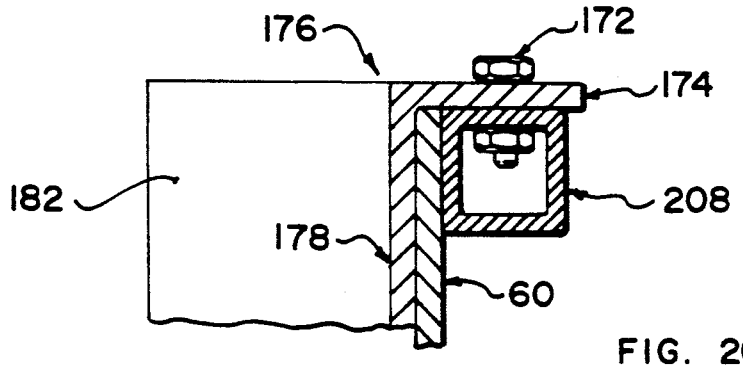
FIG. 20 shows a sectional side view of an alternative mode of attachment to that of FIG. 18.
Figure 21:
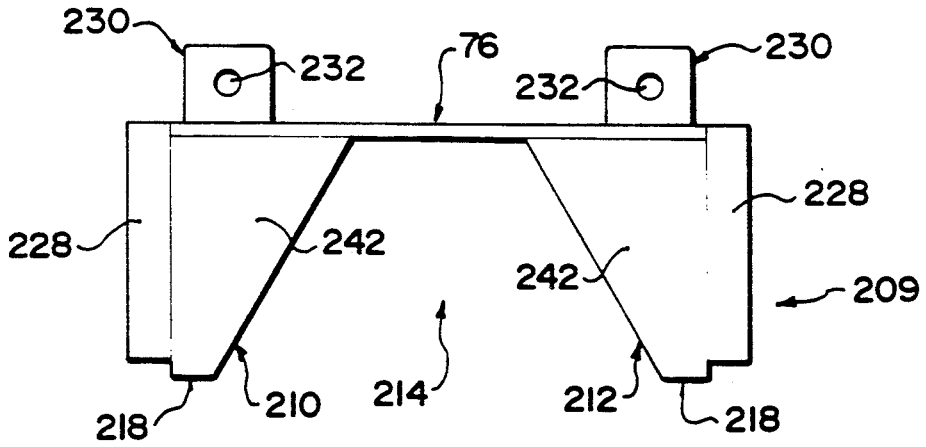
FIG. 21 shows a top view of a detachable guide for the anvil for use with the embodiment of FIG. 1.
Figure 22:
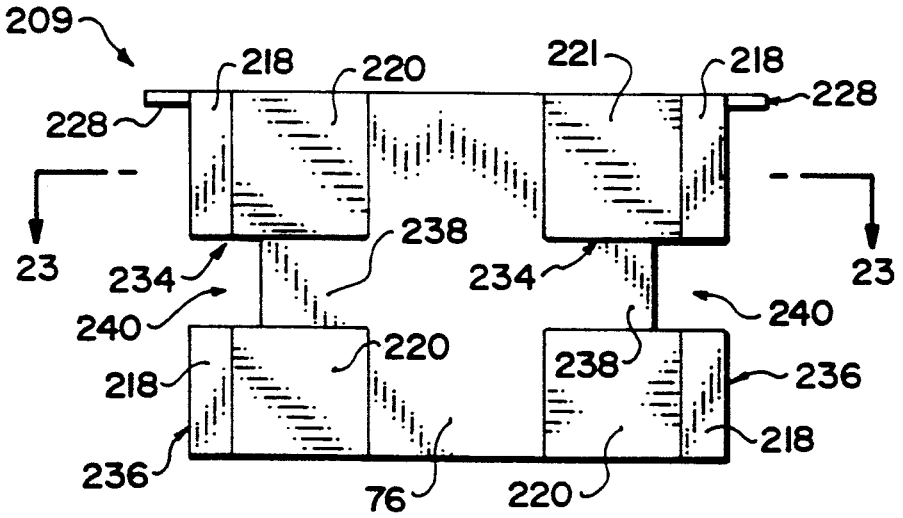
FIG. 22 shows a front view of the guide of FIG. 21.
Figure 23:
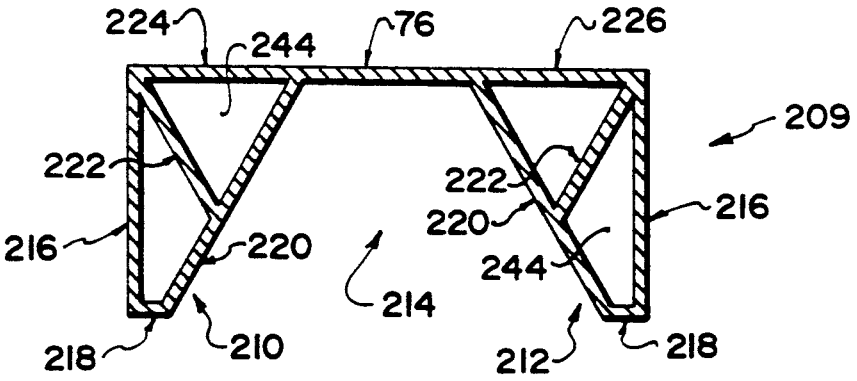
FIG. 23 shows a sectional view of the guide of FIG. 21.

Another further strengthened gate embodiment is shown in FIGS. 17 and 18, in this variant the structure is similar but six bolts 164, five gussets 166, and two optional outer gussets 186 and two support angle irons 184 are provided, pins 89 are indicated. Details of the attachment use of 184 are shown in FIG. 18, where angle iron 184 is welded to angle iron 60. In FIG. 20 is shown another attachment variation, where square tube 208 is welded to angle iron 60 replacing angle iron 168.

An optional suspending protecting frame 188 attachable to cutter 10 is shown in FIG. 19. Frame 188 has four vertical members 190, 2×2×0.5 or 0.0375 inch square tubular steel, each having base flanges 192, which may be welded to side members 14 and 16, or bolted thereto by bolts 194. Front cross member 196, similarly of 2×2×0.5 or 0.375 square tubular steel is welded to front laterally opposed vertical members 190. At the top of vertical members 190 are welded cross diagonal members 198 inclining inward and upward to meet at longitudinal spar 200, of 4×1 inch steel. Reinforcing gussets 201, of 0.5 inch steel are welded at the joins of front diagonal members 198 with each other and front cross member 196. At the joins of rear vertical members 190 and rear diagonal members 198 are welded 0.5 inch reinforcing plates 199. Spar 200 projects beyond members 198 forming projections 202 and 204. A series of round apertures 206 are bored through the spar 200 allowing attachment of cables for suspension for hydraulic equipment. One point suspension is adequate, but two point suspension is preferred. Besides the suspension utility the frame forms a protective cage for the hydraulic cylinders and their attachments. Taller piles fall randomly when cut, and it is desirable to avoid damage to the cylinders. Frame 188 is conveniently made of steel of sufficient thickness and strength to withstand a falling concrete pile. Those skilled in the art will understand the type of steel required.

In FIGS. 21 to 24 is shown guide attachment 209 for anvil gate 18 to be used with the single cutter blade 20. This attachment is a variation of protective plate 76, which forms the back plate of guide 209. Wedges 210 and 212 project forward from back plate 76 forming semihexagonal recess 214. Recess 214 is thus adapted to receive hexagonal precast reinforced piles. The dimensions are varied depending on whether the pile is 16, 14, or 12 inches (nominal). When the pile is 16 inches, the recess sides are about 9.5 inches; when the pile is 14 inches, the recess sides are about 8.5 inches; when the pile is 12 inches the recess sides are about 7.5 inches. The wedges 210 and 212 each have side plates 216 extending about 8.5 inches perpendicular from back plate 76, front plates 218 parallel to back plate 76, and angled recess plates 220 extending to back plate 76. Reinforcing gusset or rib 222 extends from the junction of plates 76 and 216 to the mid point of recess plate 220. Wedges 210 and 212 and plate 76 are welded from 0.5 inch steel. The protective plate 76 in one form is about 21 inches across and 10 inches deep. In this form the bases 224 and 226 of wedges 210 and 212, are about 6 inches for the 16 inche pile, about 6.5 inches for the 14 inch pile and about 7 inches for the 12 inch pile, the front plate 218 are respectively about 1 inch for the 16 inch pile, about 2.5 inches for the 14 inch pile and about 3.5 inches for the 12 inch pile. When the pile is 16 inch front plate 218 may be omitted as side plate 216 and recess plate 220 may be welded directly together. Lugs or flanges 228 are welded to the outer sides of wedges 210 and 212 at the top, extending outward about 1.25 inches, these engage side members 14 and 16 of cutter 10 at the top of angle irons 40, preventing the guide 209 from falling through cutter 10, lugs or flanges 228 also function as handles to lift the guide from the cutter. Optional tabs or lugs 230 having holes 232 project backward from plate 76, these tabs are so located that when plate 76 abuts angle iron 60 of anvil gate 18, pins 89 extending down holes 87 engage holes 232. This prevents sliding movement of guide 209 during cutter maneuvering. The wedges 210 and 212 have upper sections 234 and lower sections 236 separated by gap 238 to allow blade edge 22 to completely sever the pile and its reinforcements. The upper sections are about 4 inches deep, the lower sections about 3.5 inches deep, while the gap is about 2.5 inches deep.

Recess 240 extends inward about 2 inches on either side of plate 76 into gap 238, between upper and lower wedge sections 234 and 236, this allows compacted broken concrete to be pushed out of the way of the sides of blade edge 22. Upper wedge sections 234 are sealed to form a box by top plates 242 and bottom plates 244. Lower wedge sections 236 are constructed to the same plan as upper wedge sections 234, except they lack top and bottom plates.

In a minor variant plate 76 is 20.5 inches wide to allow easier removal of guide 209 from the cutter. The wedges 210 and 212 are narrowed at base and front by 0.25 inch each side, while lugs 228 project about 0.25 inches more.

Figure 24:
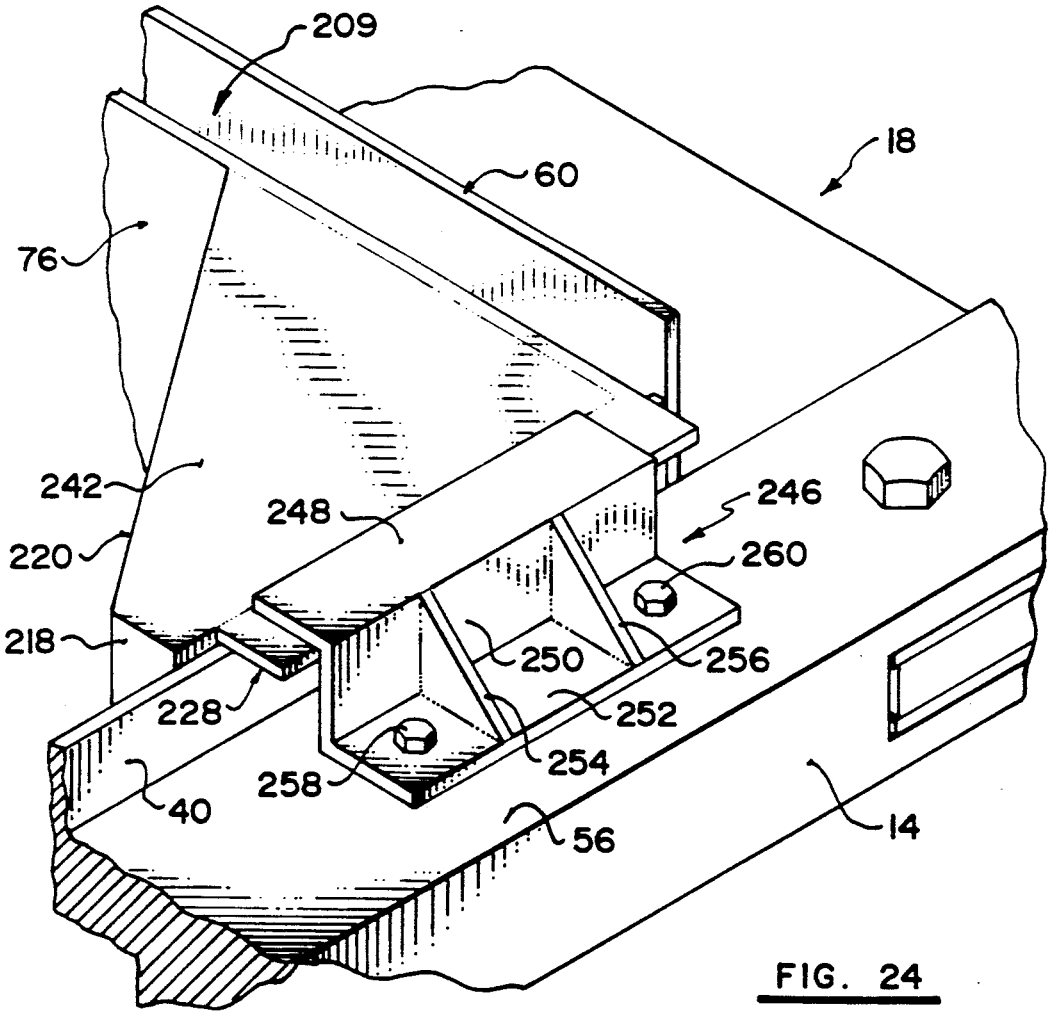
FIG. 24 shows a perspective view of the guide of FIG. 21 in use.

In FIG. 24 is shown securing bracket 246 for lug or flange 228 of guide 209. Bracket 246 has projecting upper flange 248, which in position overlies flange 228, flange 248 joins upright section 250, which itself joins lower flange 252 overlying top plate 56 of side member 14 (of cutter 10) to which lower flange 252 is secured by bolts 258 and 260. Gussets 254 and 256 reinforce section 250 and lower flange 252. In use the guide is dropped into the cutter then slid to abut the anvil gate 18, to remove the guide the blade is retracted the guide slid away from the anvil gate and lifted out by lugs 228 acting as handles.

In use when blade edge 22 cuts into a pile, there is a tendency for guide 209 to be forced up or down relative to cutter 10. When forced down lugs or flanges 228 engage angle irons 40 of side member 14 (and 16) preventing further movement. When forced up lugs or flanges 228 engage upper flange 248 of bracket 246 preventing further movement.

On a site it is intended to shear the piles to grade using cutter 10 and single blade 20, then to remove single blade 20 and replace it with double blades 84 and 86 in cutter 10, and then shear the concrete from the piles leaving the reinforcements intact. To replace the blades bolts 78 and anvil gate 18 are removed, the blade(s) changed and bolts 78 and anvil gate 18 replaced.

When piles are crowded together as sometimes happens, or close to an existing building, it may be necessary to remove one of bolts 78 to swivel gate 18 to maneuver cutter 10 around a pile to be cut, gate 18 and bolt 78 are replaced before cutting the pile. More rarely it may be necessary to remove both bolts 78, and gate 18 to maneuver cutter 10 around a pile to be cut, gate 18 and bolts 78 are replaced before cutting the pile. When blade 86 is present it is swiveled or removed with anvil gate 18. Applicant has found that the cutter of the invention is about 90 to 95% efficient, that is it is possible to cut some 90 to 95% of the piles on a site, using the cutter of the invention.

Figure 11:
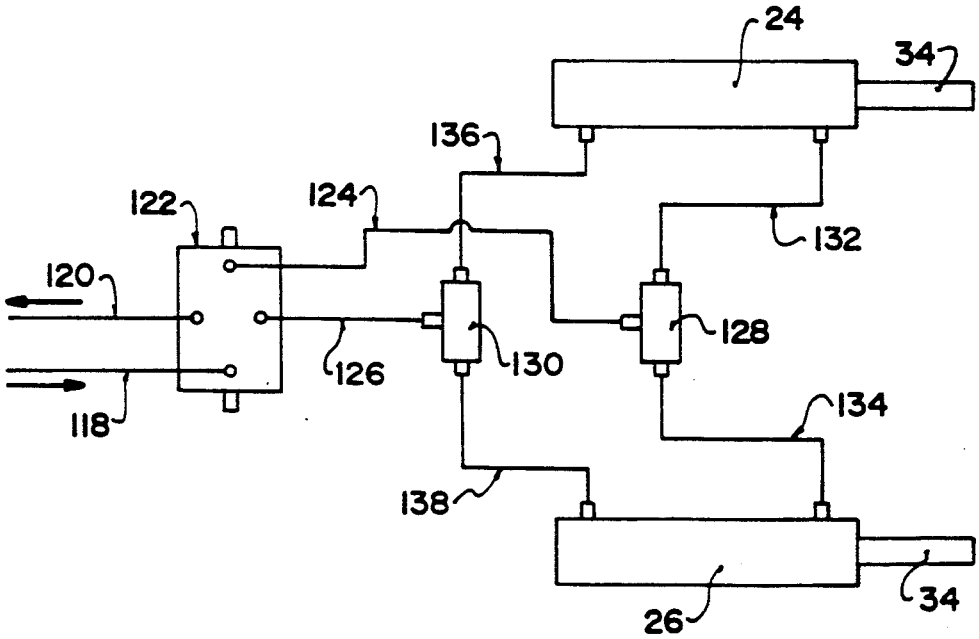
FIG. 11 is a schematic view of a hydraulic system employed in the invention.

The hydraulic circuitry, shown schematically in FIG. 11, is supplied by paired hydraulic pressure lines 118 (inlet) and 120 (return) leading to electrically controlled 2 way valve 122. Line 124 connects valve 122 to flow divider or tee joint 128 which is connected by line 132 to the front of cylinder 124, and by line 134 to the front of cylinder 26. Line 126 connects valve 122 to flow divider or tee joint 130 which is connected by line 136 to the rear of cylinder 24, and by line 134 to the front of cylinder 26. In use valve 122 is switched to connect inlet line 118 to line 124, and return line 120 to line 126. Hydraulic flow then passes along line 124 to flow divider 128, where the flow divides equally passing along lines 132 and 134 into the front of cylinders 24 and 26. This flow then pushes the cylinder pistons (not shown) backwards retracting rods 34, and thus the attached cutter plate. The hydraulic fluid in the rear of cylinders 24 and 26, flows out through lines 136 and 138 to tee junction 130, thence via line 126 through valve 122 to line 120. To reverse direction of the cylinders, valve 122 is switched to connect inlet line 118 to line 126, and return line 120 to line 124. Hydraulic flow then passes down line 126 to flow divider 130 thence along lines 136 and 138 to the rear of cylinders 24 and 26 impelling the cylinder pistons (not shown) forward, and extending rods 34 and thus the attached cutter plate. Hydraulic fluid in the front of cylinders 24 and 26, flows out through lines 132 and 134 to tee junction 128, thence via line 124 through valve 122 to line 120.

Although the invention is described with reference to the above noted reinforced concrete piles, it will be apparent to those skilled in the art that it is applicable to other styles of concrete piles of different cross section and internal structures.

As those skilled in the art would realise these preferred illustrated dimensions, details and components can be subjected to substantial variation, modification, change, alteration, and substitution without affecting or modifying the function of the illustrated embodiments. Although embodiments of the invention have been described above, it is not limited thereto, and it will be apparent to persons skilled in the art that numerous modifications and variations form part of the present invention insofar as they do not depart from the spirit, nature and scope of the claimed and described invention.

I claim:

1. A method of cutting off the concrete at one end of a concrete pile while leaving reinforcement in the pile intact, said method comprising:

providing two substantially coplanar blades with opposed cutting edges, each cutting edge comprising a reentrant of similar shape to and smaller than the perimeter of the pile;

engaging the cutting edges of the blades with opposite sides of the pile, in a substantially common plane; and forcing the cutting edges of the blade into the concrete of the pile.

2. The method of claim 1, wherein said cutting edge has a Rockwell C hardness of between 35 and 45.

3. The method of claim 2, wherein said cutting edge has a Rockwell C hardness of about 40.

4. The method of claim 1, wherein said pile is hexagonal in cross section and said reentrant is similarly hexagonal.

5. A method according to claim 1 further comprising engaging the pile above said common plane with opposed projection means for shattering the concrete above said common plane.

6. The method of claim 5, wherein said cutting edge has a Rockwell C hardness of between 35 and 45.

7. The method of claim 6, wherein said cutting edge has a Rockwell C hardness of about 40.

8. The method of claim 5, wherein said pile is hexagonal in cross section and said reentrant is similarly hexagonal.

* * * * *